US008795034B2

(12) United States Patent
Andrews et al.

(10) Patent No.: US 8,795,034 B2
(45) Date of Patent: Aug. 5, 2014

(54) BRAZED DIAMOND DRESSING TOOL

(75) Inventors: Richard M. Andrews, Long Valley, NJ (US); Sergej-Tomislav Buljan, Acton, MA (US); Earl G. Geary, Jr., Framingham, MA (US); Robert L. Owen, Horse Shoe, NC (US); Marcus R. Skeem, Sandy, UT (US)

(73) Assignee: Saint-Gobain Abrasives, Inc., Worcester, MA (US)

( * ) Notice: Subject to any disclaimer, the term of this patent is extended or adjusted under 35 U.S.C. 154(b) by 768 days.

(21) Appl. No.: 11/950,786

(22) Filed: Dec. 5, 2007

(65) Prior Publication Data

US 2008/0076338 A1 Mar. 27, 2008

Related U.S. Application Data

(62) Division of application No. 10/847,939, filed on May 18, 2004, now abandoned.

(51) Int. Cl.

| | |
|---|---|
| ***B24B 21/18*** | (2006.01) |
| ***B24B 33/00*** | (2006.01) |
| ***B24B 47/26*** | (2006.01) |
| ***B24B 55/00*** | (2006.01) |
| ***B25D 1/00*** | (2006.01) |
| ***B24B 53/00*** | (2006.01) |

(52) U.S. Cl.
USPC ..... 451/443; 125/11.01; 125/2

(58) Field of Classification Search
USPC ..... 451/443, 546, 547, 529; 428/615; 51/307, 309; 407/55
See application file for complete search history.

(56) References Cited

U.S. PATENT DOCUMENTS

| | | | | | |
|---|---|---|---|---|---|
| 3,495,359 | A | | 2/1970 | Phaal et al. | |
| 3,596,649 | A | | 8/1971 | Olivieri | |
| 3,828,428 | A | * | 8/1974 | Wayland | 29/875 |
| 3,841,852 | A | * | 10/1974 | Wilder et al. | 51/295 |
| 3,886,926 | A | | 6/1975 | Hall | |
| 3,918,217 | A | | 11/1975 | Oliver | |
| 4,158,283 | A | | 6/1979 | Nation | |
| 4,407,263 | A | * | 10/1983 | Murata | 125/15 |

(Continued)

FOREIGN PATENT DOCUMENTS

| | | | |
|---|---|---|---|
| DE | 69912752 | T2 | 9/2004 |
| DE | 69729653 | T2 | 7/2005 |

(Continued)

OTHER PUBLICATIONS

PCT Publication WO 00/06340, Andrews et al., Rotart Dressing Tool Containing Brazed Diamond Layer, Feb. 10, 2000.*

(Continued)

*Primary Examiner* — Bryan R Muller
(74) *Attorney, Agent, or Firm* — Joseph P. Sullivan; Abel Law Group, LLP

(57) ABSTRACT

A dressing blade for finishing and reconditioning new and used abrasive grinding and cutting tools has a slab-shaped shank with an extension protruding longitudinally from the shank. Superabrasive grains are disposed on the surface of the extension and held in place by a brazed metal composition. This composition is formed by brazing a powdered mixture of brazing metal components and active metal components. Specific extension configurations are provided which allow aligning the superabrasive grains in single layer arrangement for precise dressing and simple fabrication of the tool. The novel dressing tool exhibits excellent wear characteristics.

32 Claims, 5 Drawing Sheets

(56) References Cited

U.S. PATENT DOCUMENTS

| | | | | | |
|---|---|---|---|---|---|
| 4,685,440 | A | | 8/1987 | Owens | |
| 4,799,472 | A | | 1/1989 | Tonshoff et al. | |
| 4,805,586 | A | * | 2/1989 | Borse | 125/11.01 |
| 4,968,326 | A | | 11/1990 | Wiand | |
| 5,049,165 | A | * | 9/1991 | Tselesin | 51/295 |
| 5,102,621 | A | | 4/1992 | Sara | |
| 5,131,924 | A | | 7/1992 | Wiand | |
| 5,190,568 | A | * | 3/1993 | Tselesin | 51/293 |
| 5,492,771 | A | | 2/1996 | Lowder et al. | |
| 5,505,750 | A | | 4/1996 | Andrews | |
| 5,725,421 | A | * | 3/1998 | Goers et al. | 451/303 |
| 5,785,039 | A | | 7/1998 | Kobayashi et al. | |
| 5,832,360 | A | | 11/1998 | Andrews et al. | |
| 5,846,269 | A | | 12/1998 | Shiue et al. | |
| 5,855,314 | A | | 1/1999 | Shiue et al. | |
| 5,976,205 | A | | 11/1999 | Andrews et al. | |
| 5,997,597 | A | | 12/1999 | Hagan | |
| 6,039,641 | A | | 3/2000 | Sung | |
| 6,102,024 | A | | 8/2000 | Buljan et al. | |
| 6,187,071 | B1 | | 2/2001 | Andrews et al. | |
| 6,193,770 | B1 | | 2/2001 | Sung | |
| 6,200,208 | B1 | | 3/2001 | Andrews et al. | |
| 6,245,443 | B1 | | 6/2001 | Shiue et al. | |
| 6,264,882 | B1 | | 7/2001 | Colella et al. | |
| 6,416,878 | B2 | | 7/2002 | An | |
| 6,485,532 | B2 | | 11/2002 | Andrews et al. | |
| 6,537,140 | B1 | * | 3/2003 | Miller et al. | 451/259 |
| 6,817,936 | B1 | | 11/2004 | Skeem et al. | |
| 2001/0033804 | A1 | | 10/2001 | An | |

FOREIGN PATENT DOCUMENTS

| | | | |
|---|---|---|---|
| DE | 69833314 | T2 | 10/2006 |
| EP | 0864399 | A2 | 9/1998 |
| EP | 1782919 | A2 | 5/2007 |
| JP | 2-27855 | U | 2/1990 |
| JP | 2002126997 | A | 5/2002 |
| JP | 2002273657 | A | 9/2002 |
| JP | 2003309094 | A | 10/2003 |
| WO | 99/46077 | A2 | 9/1999 |
| WO | 0006340 | A1 | 2/2000 |

OTHER PUBLICATIONS

German Office Action, dated Oct. 1, 2009, from corresponding German Application No. 11 2005 001 119.4-14.

English Translation of Japanese Office Action, mailed Nov. 10, 2009, from corresponding Japanese Application No. 2007-527245.

English Summary of German Office Action dated May 11, 2010, issued in related German Application No. 11 2005 001 119.4.

English translation of Swedish Office Action dated Apr. 9, 2008 from related Swedish Patent Application No. 0602424-4.

Specification Manual, "Norton Segments, Cut-off Wheels, Grinding Wheels, Superabrasive Wheels, Sticks & Stones and Dressing Tools," 1992, pp. 64-78.

* cited by examiner

BRAZED DIAMOND DRESSING TOOL

RELATED APPLICATIONS

This application is a Divisional of U.S. application Ser. No. 10/847,939, filed on May 18, 2004 which is incorporated herein by reference in its entirety.

FIELD OF THE INVENTION

This invention relates to a tool for dressing the abrasive portions of grinding or cutting tools. More specifically, it relates to a dressing tool having diamond grains affixed to a metal shank by a brazed metal composition.

BACKGROUND OF THE INVENTION

Dressing refers to an abrasive operation frequently used in fabricating new or reconditioning used abrasive tools, i.e., grinding or cutting tools. These tools typically have a structurally supportive core and an abrasive portion of discrete abrasive grains held to the core by a binding component. A grinding wheel is a common example of such a tool. As initially produced, such tools often exhibit slight geometric irregularities, especially at the surface, that define the operative cutting edge of the tool. Also, abrasive tools routinely become dull as they are used. Dullness results largely from retention by the binding component of worn abrasive particles exposed to repeated impact with the work piece. It is also caused by a loss of exposed cutting edge as spaces between the abrasive particles are filled by abrasion debris.

The dressing operation normally involves mechanical shaping of an abrasive tool in which the dressing blade is held against or applied to the cutting edge and produces controlled abrasion of the tool. Dressing removes excess material from high spots of the abrasive portion. Manufacturers thus normally use dressing in late steps of abrasive tool fabrication to shape the cutting edge to a desired profile. Dressing also refers to making the tool dimensions conform precisely with design tolerance specifications. For example, dressing can be used on a grinding wheel in such a fashion that the cutting edge of the wheel will run true when it rotates in operation. Dressing also can sharpen and restore used tools to free cutting condition. This is done by abrasively removing bond material that has failed to erode to expose new underlying abrasive grains after outer grains have been consumed, and sculpting out work piece debris and binding component residue which accumulate between grains during primary grinding operations.

An abrasive portion of a conventional dressing tool typically contains diamond grains positioned systematically or randomly, often in a planar arrangement. The abrasive portion is joined to a base which allows fixing the tool to a machine adapted to carry out dressing. The abrasive portion is applied to the base so that the cutting edge of the dressing tool can be disposed tangentially to the abrasive tool to be dressed. Controlled abrasion is effected by the diamond grains which are located at the tip of the dressing tool and are outwardly exposed to the abrasive tool.

Wear characteristics of a dressing tool during the dressing process are a great concern for the manufacturer of abrasive tools. If the dressing tool wears rapidly, it must be replaced with high frequency. Dressing tools use costly materials such as diamond. They are made to high standards of quality and dimensional precision. Hence, the fabrication of dressing tools is usually complicated and labor intensive, and dressing tools are relatively expensive. Therefore, it is important to the manufacturer of abrasive tools to have available durable dressing tools that provide extended service life.

Wear of the diamond grains of the dressing tool is relatively minor because the abrasive portion of the tool being dressed is generally softer than the diamond. Significant wear stems from deterioration of the bonding material that joins the diamond to the base of the dressing tool. A major reason for deterioration is that the bonding material is itself worn away by contact with the work piece during dressing. The mass of bonding material embedding diamond grains diminishes during service until an insufficient amount of material remains to retain those grains. Usually a metallic bonding material is used to surround the diamond grains of dressing tools as a means to withstand the abrasive action of the grinding wheel. Preferably, the composition of the metal bond in which diamond grains are embedded is selected to provide a fairly high wear resistance.

Metal bonds of diamond grains to dressing tools are conventionally affected with compositions that include metal elements, metal compounds and alloys thereof. The metal bond composition is sometimes formed by a brazing process. Broadly summarized, this process involves heating a well dispersed mixture of fine particles of the components to a temperature at which they melt and flow around the grains. Then the tool is cooled so that the fused bond composition solidifies, embeds the grains and adheres them to the metal base of the tool. Another metal bonding technique includes compressing diamond grains and a metal powder mixture to form a compacted abrasive element of preformed shape. Heat treating the compacted abrasive element causes sintering, i.e., densifying the metal powder mixture without liquefying the entire mixture such that the diamond grains become bound by the sintered metal. This is occasionally referred to as powder metallurgy bonding technology.

Another significant factor contributing to premature release of the diamond grains from the dressing tool is strength of the metal bond. Weaker bonds will fail and release diamond grains under service conditions more quickly than stronger bonds, and thus weakly bonded tools will suffer from accelerated wear.

Diamond normally does not bond well to many metals and metal alloys that are desirable for brazed bond compositions. Techniques have been developed to increase bond strength that entail incorporating a reactive metal ingredient such as titanium, chromium or zirconium, in the precursor bond composition. This reactive metal ingredient is characterized by its ability to react directly with the diamond grain to form a strong chemical bond with the grain. These so-called "active metal" bond compositions thus have both non-reactive and reactive components. Usually the non-reactive components constitute most of the bond composition. The non-reactive components alloy to form a strong and durable bond which is adhesive to the base. The reactive component tenaciously attaches by chemical bond to the superabrasive and is cohesive with the non-reactive alloy. For example, U.S. Pat. No. 4,968,326 to Wiand discloses a method of making a diamond cutting and abrading tool which comprises mixing a carbide forming substance with a braze alloy and temporary binder, applying the mixture to a tool substrate, applying diamond particles onto the mixture coated tool and heating the thus combined materials to initially form a carbide coating on the diamond. Thereafter the carbide coated diamond is brazed to the tool. The brazing alloys disclosed are nickel, silver, gold or copper based.

It is a particularly important aspect of creating a durable dressing tool that the metal bond composition embedding the diamond grains has an adequate interface with the metal base to provide strong attachment. Geometry of the base can be an important factor. FIG. 4 of PCT Publication No. WO 00/6340 (Feb. 10, 2000) illustrates the rim construction of a rotary dressing tool in which four abrasive grains are arranged in a stack to form a single grain width cutting edge protruding from the metal core of the tool. The rim is formed to a width equal to the width of the grains so that only a narrow circumferential area of the rim is in contact with the bond material and there is no lateral support other than the structure of the inter-grain bond material. Other dressing tool configurations such as FIGS. 2 and 3 of U.S. Pat. No. 4,805,586, include a metal backing structure of the dressing tool base. This backing structure provides more area for the metal bond to adhere to the base and thus should provide a stronger connection between the metal bond and the base.

It is desirable to have a dressing tool that has superior wear resistance such that the frequency of dressing tool replacement can be reduced. It is also very much desired to provide a dressing tool that can be fabricated more simply and less laboriously than conventional tools.

SUMMARY OF THE INVENTION

Accordingly, this invention now provides a dressing blade for conditioning abrasive tools comprising (i) a slab-shaped metal shank defining a flat base and a flat top parallel to the base and having an extension protruding longitudinally from an end of the shank, (ii) superabrasive grains and (iii) a brazed metal composition operative to chemically bond the superabrasive grains to the extension, wherein the brazed metal composition is a thermally densified mass comprising a brazing metal component and an active metal component, and wherein the superabrasive grains are uniformly dispersed within the brazed metal composition and are in a single layer in contact with each adjacent grain.

There is also provided a dressing blade for conditioning abrasive tools comprising (i) a slab-shaped metal shank defining a flat base and a flat top parallel to the base and having a metal extension protruding longitudinally from an end of the shank, (ii) and an abrasive portion comprising superabrasive grains and a brazed metal composition operative to bond the superabrasive grains to the extension, wherein the extension is a flat sheet having one side flush with the base and the opposite side defining a flat face, and in which the superabrasive grains are uniformly dispersed within the brazed metal composition, positioned adjacent to the flat face and are in a single layer such that each grain is in lateral contact with each adjacent grain.

There is further provided a dressing blade for conditioning abrasive tools comprising (i) a slab-shaped metal shank defining a flat base and a flat top parallel to the base and having a metal extension protruding longitudinally from an end of the shank, (ii) and an abrasive portion comprising superabrasive grains and a brazed metal composition operative to bond the superabrasive grains to the extension, wherein the superabrasive grains are uniformly dispersed within the brazed metal composition and are in a single layer in contact with each adjacent grain and wherein the extension comprises a plurality of elongated flat walls parallel to each other and perpendicular to the base of the shank to form elongated alleys between consecutive walls, and in which the superabrasive grains and brazed metal composition are positioned in the alleys.

The invention also relates to a method for preparing a dressing tool comprising: a) providing a slab-shaped metal shank defining a flat base and a flat top parallel to the base and having an extension protruding longitudinally from an end of the shank; b) applying to the extension a layer of brazing metal composition comprising a brazing metal component and an active metal component; c) pressing superabrasive grains into the paste to form a single layer of superabrasive grains in lateral contact with each adjacent grain to obtain a tool precursor; and d) heating the tool precursor to liquefy the brazing metal composition and create a bond between the components of the brazing metal composition and the superabrasive grains.

The above and other features of the invention including various details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The novel dressing tool of the invention includes a metal shank having an extension formed to the shape of a blade adapted to support and retain an abrasive portion during operation. The operative abrasive in the abrasive portion is superabrasive material in discrete particle form, occasionally referred to herein as "grains". The superabrasive particles are affixed to the blade with a bond effected by a brazed metal composition. The cross section of the working section of the tool is optimized as hereinafter explained to provide appropriate lateral stiffness.

Figure 1A:
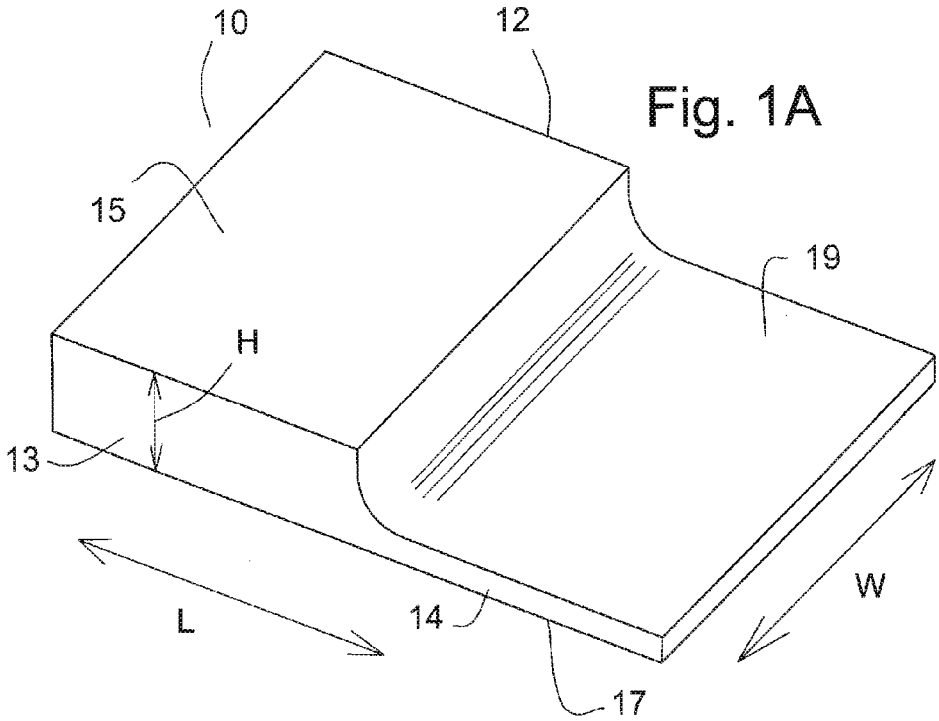
FIG. 1A is a perspective view of a shank and extension of a basic embodiment of a dressing blade according to this invention.

The structure of the novel dressing tool can be better understood with reference to the figures of which like elements have identical reference numbers. As seen in FIG. 1A, the dressing tool 10 has a slab-shaped body 12 with a shank 13 and an extension 14 extending longitudinally from one end of the shank. This disclosure adopts the convention that the directions relative to the structure of the dressing tool identified by arrows labeled L, W and H in FIG. 1A are the longitudinal (or length), lateral (or width) and height, respectively. The illustrated tool has a flat top 15 and a flat base 17 parallel to the top. The primary purpose of the shank is to provide a handle by which the tool can be gripped by a dressing machine (not shown) suitably adapted to accept the shank. Although the shank of the illustrated tool is a rectangular prismoid shape, other shapes can be used. For example, the shank can have a parallelogram, trapezoid or other lateral cross section.

The extension 14 as shown is an integral part of the body of the tool. This structure is preferred and can be formed by machining the shank and extension from a single piece of stock material. Alternatively, the extension can be formed as a separate piece and attached to the shank by suitable conventional means. The extension should be rigidly affixed to the shank and because the tool will be subjected to high stresses during operation, robust mechanical fastening techniques such as clamping and bolting are recommended for separate shank-extension type tools.

Figure 1B:
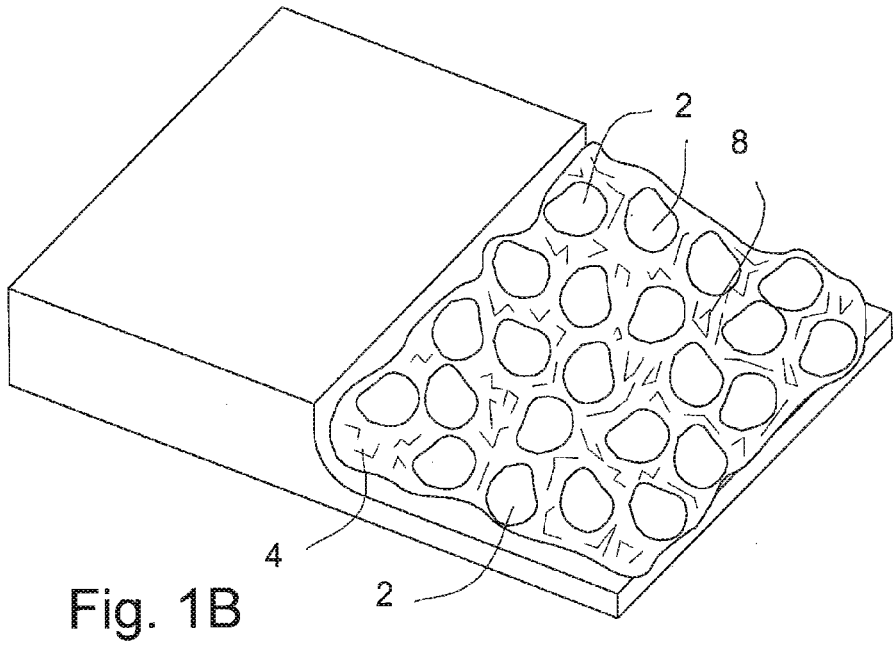
FIG. 1B is a perspective view of a dressing blade formed using the shank and extension of FIG. 1A.

The dressing tool typically has a length of about 30-50 mm and a width of about 10-20 mm. The height of the shank is usually about 2-3 mm. The height of the extension is reduced to provide space for the brazed metal abrasive portion 2, 4, 8 (FIG. 1B). The illustrated extension 14 is a flat sheet extending longitudinally from one end of the shank and flush with the base 17. As mentioned, the extension should be strong enough to retain integrity and rigidity during operation. It is important that the blade have sufficient rigidity that the superabrasive grains at the tip (i.e., the cutting edge of the extension farthest from the shank) of the dressing tool are dimensionally stabilized with respect to the work piece being dressed. This permits controlled abrasion with precise placement of the tip against the work piece to be accomplished. If the height is too small, the extension may deform or break. Preferably the height of the extension is about 10-25% of the height of the shank. The extension extends laterally to the full width of the shank. In other embodiments, the extension can have reduced width.

As seen in FIG. 1B, the abrasive portion 4 includes a plurality of superabrasive particles 2. The brazed metal composition 8 bonds the particles to the surface 19 of the extension. It is a novel feature of the present invention that the superabrasive particles are preferably placed such that they are in lateral contact with each adjacent particle and present in a single grain thickness. In a single layer device, the superabrasive particles are preferably selected to have substantially similar particle sizes.

The value of the one-grain high conformation is that there is always a one grain-high superabrasive surface presented to the tool being dressed at all times as the dressing tool wears down. This provides geometric precision and extraordinary high dressing tool service life (volume of work ground away per unit volume of dressing tool superabrasive worn away).

It is customary to classify abrasive particles by filtering the particles through sieves of known opening dimensions, i.e., sieve hole size. The abrasive particles are thus identified by characteristic diameters corresponding to the size of the opening of those sieves through which the particles pass and those which retain the particles. The thickness of a single layer abrasive portion is preferably less than two characteristic diameters of the superabrasive particles being utilized. The actual thickness of the abrasive portion will be slightly different from the actual diameter of any specific superabrasive particle because individual particle sizes vary slightly from the characteristic diameter and also because of the thickness added by the brazed metal composition that embeds the superabrasive particles.

In another preferred embodiment (FIGS. 2A and 2B), the extension 24 further comprises a pair of side panels, 21A, 21B, positioned on opposite lateral sides of the extension. The side panels rise above the level of the flat surface 29 of the interior portion of the extension and, in combination with that surface, form a single channel 23. The side panels provide increased blade rigidity for precision cutting and enhanced support and surface to which the brazed metal composition can bond. Thus the superabrasive particles 2 are more firmly bound to the extension and better resist being dislodged by impact with the work piece being dressed. As shown, height of the side panels 21A, 21B is less than the height of the shank 13. Other configurations are contemplated. For example, the side panel height can be uniformly equal to the full height of the shank for the whole length of the extension, or the side panel can have a height profile that varies with longitudinal distance from the shank. This contributes to providing the dressing tool with a longer useful service life.

Optionally, the extension can additionally include an end panel 25 positioned at the end of the extension distant from the shank. The end panel normally extends laterally over the full width of the extension. If present, the height of the end panel should be such that the top 26 of the end panel is elevated above the flat surface 29 of the extension. The height of the end panel can be as high as the flat top 15 of the shank. It is thus seen that the side panels, the end panel and the shank form a tray that holds the brazed metal composition and superabrasive particles therein. The tray can additionally facilitate fabrication of the dressing tool as will be more fully described below. If the end panel extends to a height that intervenes between the outermost superabrasive particles 22 and the work piece being dressed (not shown), then initial use of the dressing tool will involve abrading away the end panel to an extent sufficient to expose particles 22.

In another preferred embodiment (FIGS. 3A and 3B), the novel dressing tool comprises a plurality of elongated flat walls 31 which extend longitudinally from the shank 13. The walls are parallel with each other and preferably with the sides of the tool body. They are also preferably oriented in planes perpendicular to the base of the shank. Neighboring pairs of walls form longitudinal alleys 33. Superabrasive particles 2 bonded to the walls of the extension by brazed metal composition are positioned in the alleys.

Figure 3A:
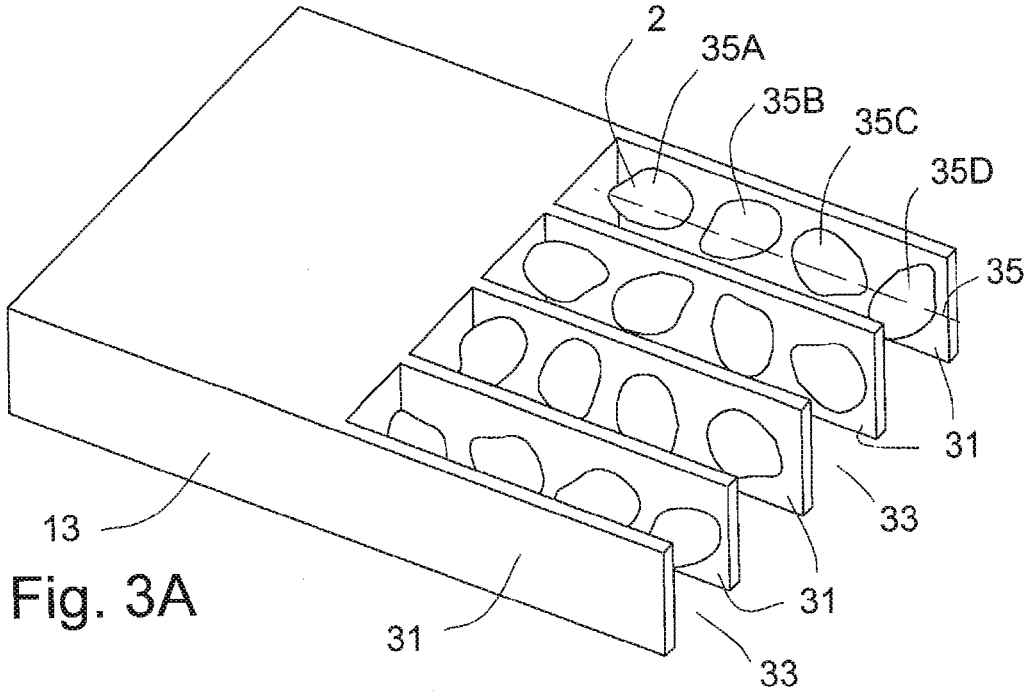
FIG. 3A is a perspective view of a shank and extension of another preferred embodiment of a dressing blade according to this invention.
Figure 3B:
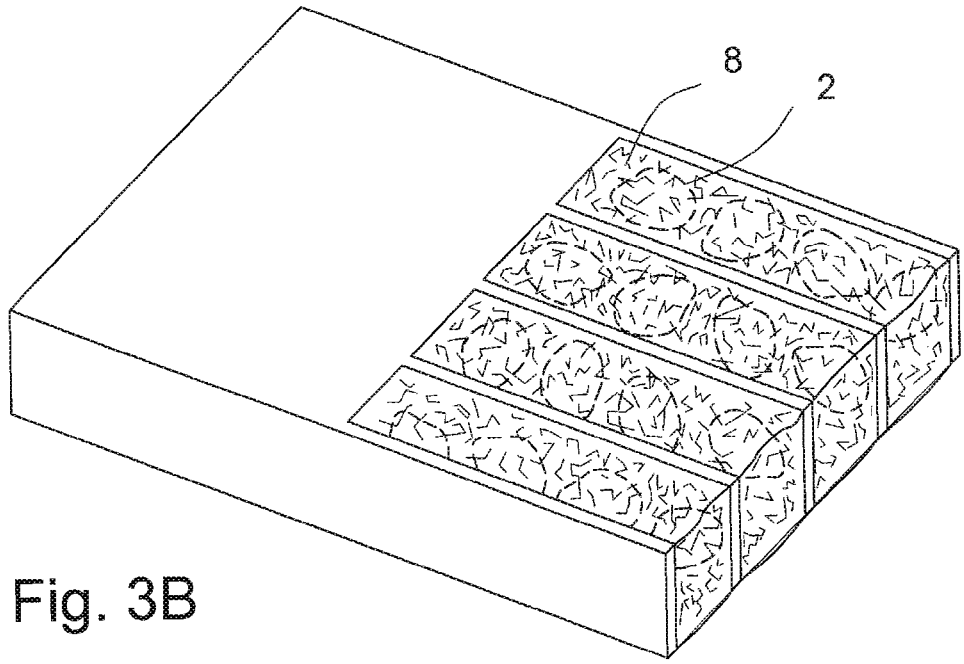
FIG. 3B is a perspective view of a dressing blade formed using the shank and extension of FIG. 3A.

Walls of the extension can extend to the full height of the shank as shown in FIGS. 3A and 3B. Lesser wall heights can be used. Suitably sized superabrasive particles can be used to provide the abrasive portion within the alleys as mentioned above. The single layer abrasive configuration of the invention is preferably characterized by superabrasive particles of substantially the same characteristic diameter and walls of less than two superabrasive characteristic diameters in height. In a particularly preferred embodiment, the superabrasive grains are arranged in single file order to form longitudinal rows, e.g., row 35 comprising grains 35A-35D, (FIG. 3A). Preferably the walls 31 are equally spaced apart laterally and the distance between consecutive walls should be less than two superabrasive characteristic diameters. This facilitates fabrication of the dressing tool such that the grains align in rows. The row-aligned configuration is preferred because blade wear is very much reduced as compared to other configurations. Consequently, tool service life is considerably extended. The walls further provide excellent surfaces for the brazed metal composition 8 to bond and thereby fix the grains within the alleys.

Figure 4A:
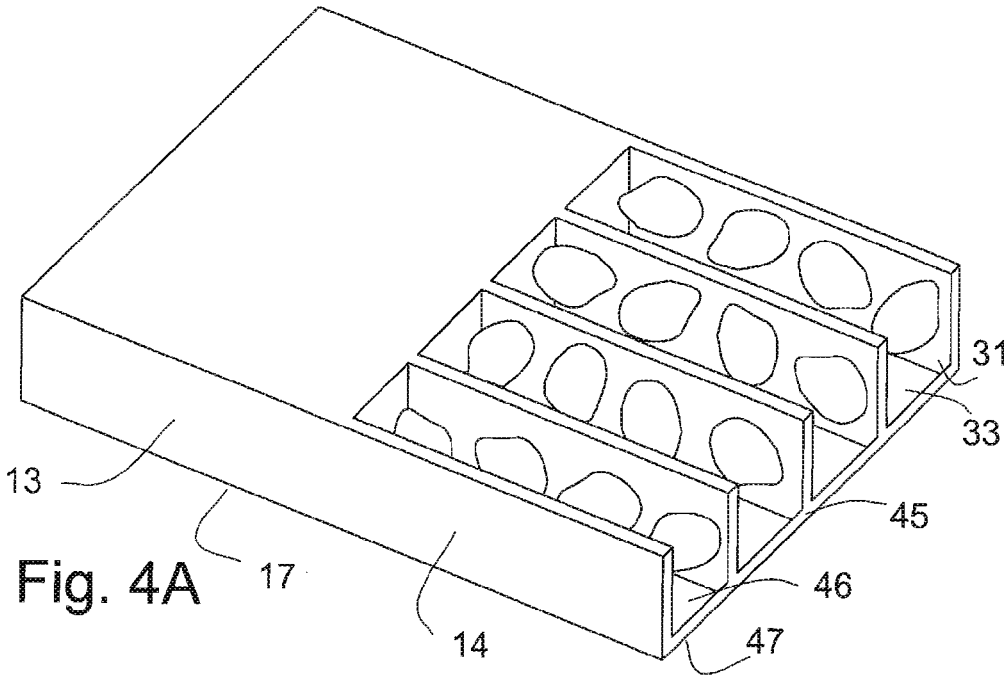
FIG. 4A is a perspective view of a shank and extension of another preferred embodiment of a dressing blade according to this invention.
Figure 4B:
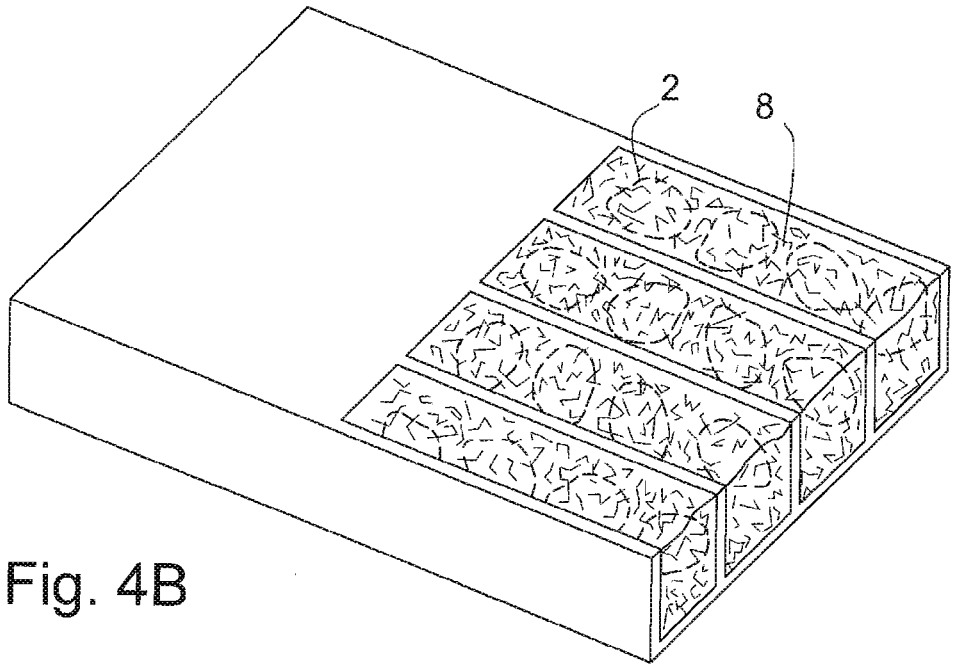
FIG. 4B is a perspective view of a dressing blade formed using the shank and extension of FIG. 4A.

FIGS. 4A and 4B illustrate another preferred embodiment of a single layer superabrasive dressing tool according to this invention. In this embodiment, the extension 14 additionally includes a flat sheet 45 extending longitudinally from the shank 13 and laterally across the width of the extension. One side of the flat sheet 46 contacts each of flat walls 31 and thereby forms a floor for longitudinal alleys 33. Preferably the opposite side 47 of flat sheet 45 is flush with flat base 17 of the dressing tool. Flat sheet 45 adds lateral stability to the blade and greater surface area for bonding the grains 2 to the extension by the brazed metal composition 8. This embodiment thus provides a stronger and more rigid blade structure than that shown in FIG. 3B. The backing function of flat sheet 45 also makes fabrication of a tool with single file, single layer abrasive grain configuration easier. Because flat sheet 45 covers one side of the blade laterally and longitudinally, the grains are exposed only at the cutting end of the blade distant from the shank and at the top side of each alley. In comparison to a so-called "two-sided" blade configuration (FIG. 3B), the blade shown in FIG. 4B is "one-sided".

Figure 5A:
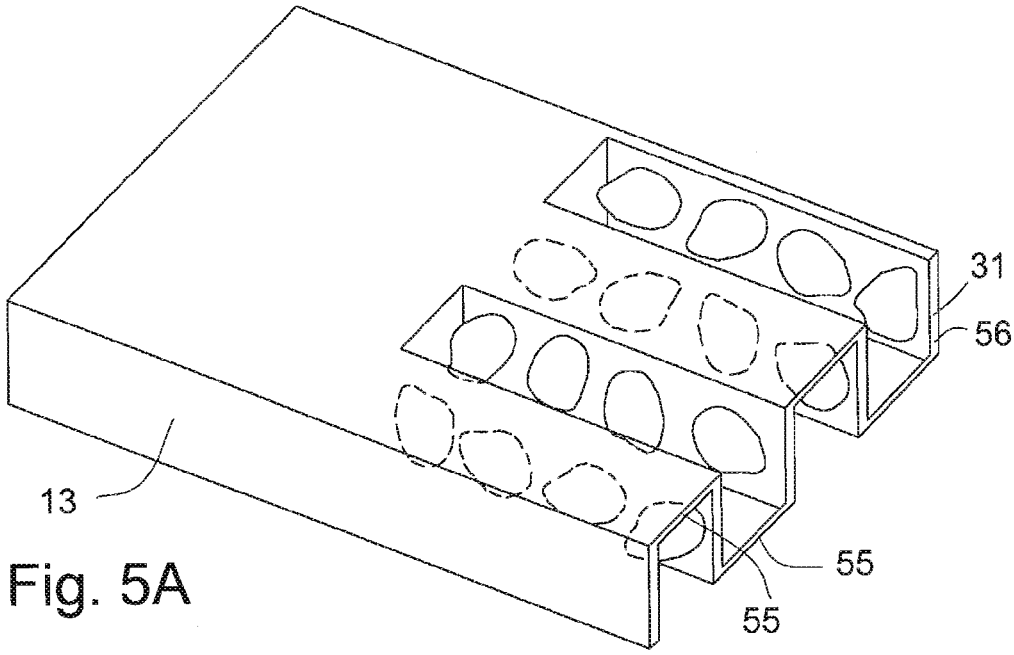
FIG. 5A is a perspective view of a shank and extension of another preferred embodiment of a dressing blade according to this invention.
Figure 5B:
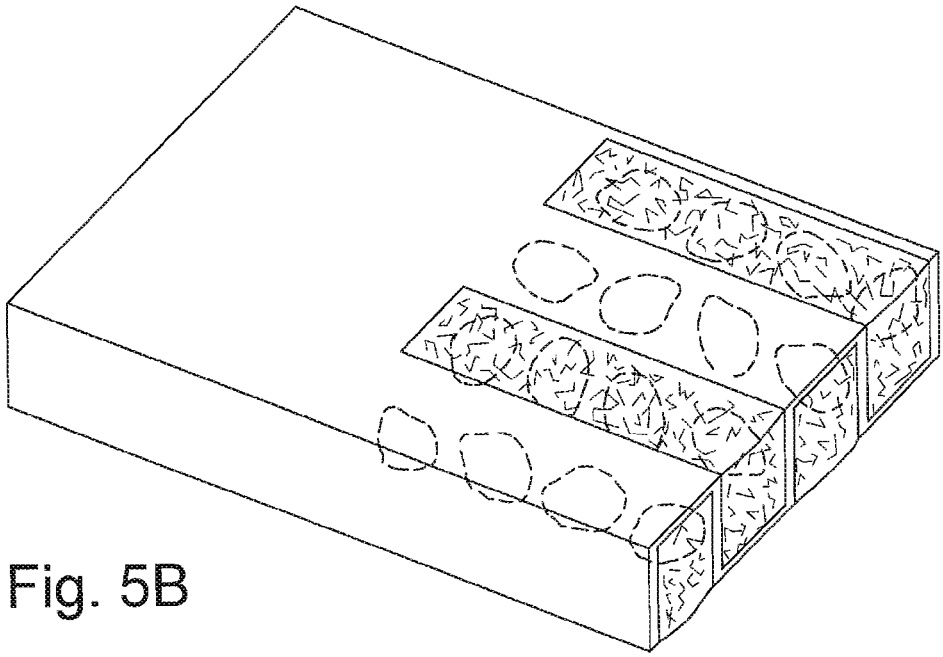
FIG. 5B is a perspective view of a dressing blade formed using the shank and extension of FIG. 5A.

FIGS. 5A and 5B depict a preferred embodiment of the novel dressing tool which incorporates beneficial features of the embodiments of both FIG. 3B and FIG. 4B. The extension comprises a plurality of flat sheets 55 which extend longitudinally from the shank 13. The sheets connect with neighboring pairs of walls 31 alternately at the top and base sides of the walls to form an orthogonal serpentine lateral cross section 56 (i.e., as seen by viewing the dressing tool blade in the longitudinal direction). Preferably the walls extend to the full height of the shank and the alternate flat sheets align flush with the top and the base. The depicted embodiment is thus a "two-sided" blade configuration. Two-sided blades advantageously provide that either side of the blade can be used to dress an abrasive tool, thus options for fixing the blade in relation to the tool are expanded. For example, two grinding wheels can be dressed simultaneously with the two-sided blade. Also, if the abrasive portion becomes dull on one side of the blade, the blade can be reversed to apply the reverse, sharper side to the work piece being dressed. The chemical bond between an active braze and diamond grain creates sufficient mechanical strength in a single layer of diamond grains to make these benefits possible.

The shank and extension should be formed from a tool strength metal. The identification of strong metal compositions for machine tool utilities is well known in the art. Representative compositions include iron, molybdenum, tungsten and alloys with metals and other elements, such as steel, tungsten/copper and the like.

The term "superabrasive" means material having extremely high hardness useful for abrading other hard substances. Diamond, cubic boron nitride and mixtures of them in any proportion are recognized as superabrasives. Diamond, natural or synthetic, is the preferred superabrasive. The superabrasive is utilized in the invention in particulate form. The term "particle" as used herein is not limited to denote any specific shape or size. Usually, the superabrasive particles are irregularly shaped, however, particles of predetermined shape, such as diamond sheet or film can be used.

The size of the superabrasive particles is selected for compatibility with design of the dressing tool. The tool is crafted to have a predetermined cutting radius and cutting edge dimension suitable for dressing preselected types of work pieces. It should be understood that the dressing tool of this invention is primarily intended to shape the cutting surfaces, sharpen, clean debris from and otherwise recondition other grinding tools. Consequently, preference is given for superabrasive particles having a characteristic dimension in the range of about 0.1 micrometer to about 5 mm. A much narrower particle size range can be employed in any given abrasive tool application. Particle sizes of typical commercial superabrasive grains usually range from about 0.0018 inch (0.045 mm) to about 0.046 inch (1.17 mm). Certain superabrasive grains of particle size sometimes referred to as "microabrasive" can range from about 0.1 micrometer to about 60 micrometers.

The novel dressing tool includes a brazed metal composition operative to bond the superabrasive grains to the extension. The term "brazed metal composition" means the densified metal bond achieved after heating of the bond components in a brazing process to fix the superabrasive grains within the metal matrix and to the metal extension of the dressing tool. The brazing process involves heating the bond composition of mixed powder particles, and optionally a liquid binder, to an elevated brazing temperature at which a major fraction of the solid components liquefy and form a liquid solution that flows around the superabrasive particles. After cooling the brazed metal composition anchors the superabrasive particles and becomes adhered to the metal extension. The brazing process utilizing components preferred for the present invention is described in detail in U.S. Pat. No. 5,832,360, the disclosure of which is hereby incorporated by reference in its entirety.

The brazed metal composition preferably comprises a brazing metal component and an active metal component. The active metal component may react with the abrasive grains under non-oxidizing sintering conditions to form a carbide or a nitride and thereby securely bond the abrasive grains in the metal matrix. The active metal component preferably includes materials such as titanium, zirconium, chromium and hafnium, and their hydrides, and alloys and combinations thereof. Titanium, or its hydride, is preferred.

Titanium, in a form that is reactive with the superabrasive has been demonstrated to increase the strength of the bond between abrasive and the brazed metal composition. The titanium can be added to the mixture of components either in elemental or compound form. Elemental titanium reacts with oxygen to form titanium dioxide and thus tends to become unavailable to react with diamond during brazing. Therefore, adding elemental titanium is less preferred when oxygen is present. If titanium is added in compound form, the compound should be capable of dissociation during the brazing step to permit the titanium to react with the superabrasive. Preferably titanium is added to the bond material mixture as titanium hydride, $TiH_2$, which is stable up to about 400-600° C. Above about 400-600° C., in an inert atmosphere or under vacuum, titanium hydride dissociates to titanium and hydrogen.

The brazing metal component for use in combination with the active metal component preferably comprises metals selected from the group consisting of copper, nickel, silver, tin, zirconium, silicon and iron. More preferably the brazing metal component comprises copper and tin. In some situations addition of silver to the mixture comprising copper and tin may be advantageous in order to facilitate the strippability of the brazed metal composition from the metal extension.

The preferable bond materials for use in forming a brazed metal composition in the present invention include copper, tin and titanium hydride powders, optionally with the addition of silver powder. Preferably the brazed metal composition for use in the invention comprises about 50-90 wt. % copper, about 5-35 wt. % tin and about 5-15 wt. % titanium or titanium hydride active metal component. More preferably the brazed metal composition comprises about 50-80 wt. % copper, about 15-25 wt. % tin and about 5-15 wt. % titanium or titanium hydride. Most preferably, the brazed metal composition comprises about 70 wt. % copper, about 21 wt. % tin and about 9 wt. % titanium or titanium hydride.

The brazed metal compositions of the novel dressing tool optionally further comprise a plurality of particles of a hard component other than materials defined herein as superabrasives. The optional hard component provides increased abrasion resistance to the abrasive tool. That is, presence of the hard component enhances the life of the metal bond so that the metal bond tends not to fail before the abrasive grain has been consumed by the dressing operations. Greater concentrations of hard component materials are needed in dressing tools which are subject to the abrasive forces encountered during reconditioning of abrasive grinding tools. The hard component is a metallic carbide or boride or a ceramic material preferably having a hardness of at least 1000 Knoop, and preferably about 1000-3000 Knoop as measured under an applied load of 500 g. Preferable hard components include tungsten carbide, titanium boride, silicon carbide, aluminum oxide, chromium boride, chromium carbide, and combinations thereof.

Preferably, the particles of the hard component material are irregularly shaped and the hard component maintains its particulate character in the matrix formed by the brazed metal composition. That is, after brazing process takes place to form the brazed metal composition from its constituent components, the hard component particles remain as distinct particulate entities dispersed in the matrix. Accordingly, it is important that the hard component should be selected from materials that do not melt below or at the braze temperature.

When hard components are utilized, the brazed metal composition is preferably about 50-83 wt. % hard component, about 15-30 wt. % brazing metal component, and about 2-40 wt. % active metal component, more preferably, about 55-78 wt. % hard component, about 20-35 wt. % brazing metal component, and about 2-10 wt. % active metal component, and most preferably about 60-75 wt. % hard component, about 20-30 wt. % brazing metal component, and about 2-5 wt. % active metal component.

It should be further understood that the braze metal composition also can include minor amounts of additional non-fugitive components such as lubricants (e.g., waxes) or secondary abrasives or fillers or minor amounts of other bond materials known in the art. Generally, such additional components can be present at up to about 5 wt. % of the brazed metal composition.

Preferably, the components of the brazed metal composition are supplied in powder form. Particle size of the powder is not critical; however powder smaller than about 325 U.S. Standard sieve mesh (44 μm particle size) is preferred. The precursor mixture for the brazed metal composition is prepared by mixing the ingredients, for example, by tumble blending, until the components are dispersed to a uniform concentration. When copper and tin are utilized as brazing metal components, it may be advantageous to supply them in the form of a powdered bronze alloy instead of as separate components. The powder mixture can be applied directly to the metal extension. Preferably, however, the dry powder components are mixed with a low viscosity, fugitive liquid binder to form a viscous tacky paste. In paste form the components of the brazed metal composition can be accurately dispensed and applied. Detailed procedures for forming and applying the operative brazed metal compositions are disclosed in U.S. Pat. No. 5,832,360, the entire disclosure of which is hereby incorporated herein by reference.

In making the novel dressing tool, a slab-shaped metal shank having an extension protruding longitudinally from an end of the shank is provided. Brazed metal composition powders, e.g., tungsten carbide, cobalt and titanium hydride powders are mixed to form a powder blend. Superabrasive grains of selected size are deposited on the extension. For single layer abrasive type dressing tools, the individual grains can be laid in place manually. Grains also can be placed robotically by pick and place equipment. In another fabrication technique a coating of volatile adhesive can be applied uniformly to the flat surface of the extension. The grains can be dropped onto the adhesive and excess grains removed by tilting the blade with a single layer of grains temporarily stuck to the extension surface. Optionally, grains can be arranged in a geometric or other pattern and can be spaced so that adjacent grains do not touch each other or spaced so they have a common boundary. With the grains in place, the powder blend can be packed around the grains. In another contemplated technique the powder blend is mixed with a fugitive liquid binder to form a paste. The paste is filled into the alley(s) of the extension. The grains are then packed into the paste and excess paste is removed, for example by wiping.

The thus assembled dressing tool precursor is next subjected to brazing conditions to permanently attach the grains to the extension. Care is taken to carry out brazing under conditions selected to avoid oxidation of the active metal component and the diamond. When titanium hydride is used as the active metal component, the temperature is elevated to allow thermal dissociation of the titanium hydride so as to form a composite containing a titanium carbide phase securely bonding the diamond into the metallic phase of the brazed metal composition. The brazing step is generally carried out under vacuum or a non-oxidizing atmosphere at a pressure of 0.01 microns to 1 micron Hg and a temperature of about 800° C. to about 1200° C. In an additional optional step, the brazed composite can be vacuum infiltrated with an infiltrant component to fully densify the abrasive tool and eliminate substantially all porosity. Although many materials may be used for this purpose, copper is preferred.

EXAMPLES

This invention is now illustrated by examples of certain representative embodiments thereof, wherein all parts, proportions and percentages are by weight unless otherwise indicated. All units of weight and measure not originally obtained in SI units have been converted to SI units.

Example 1

Figure 2A:
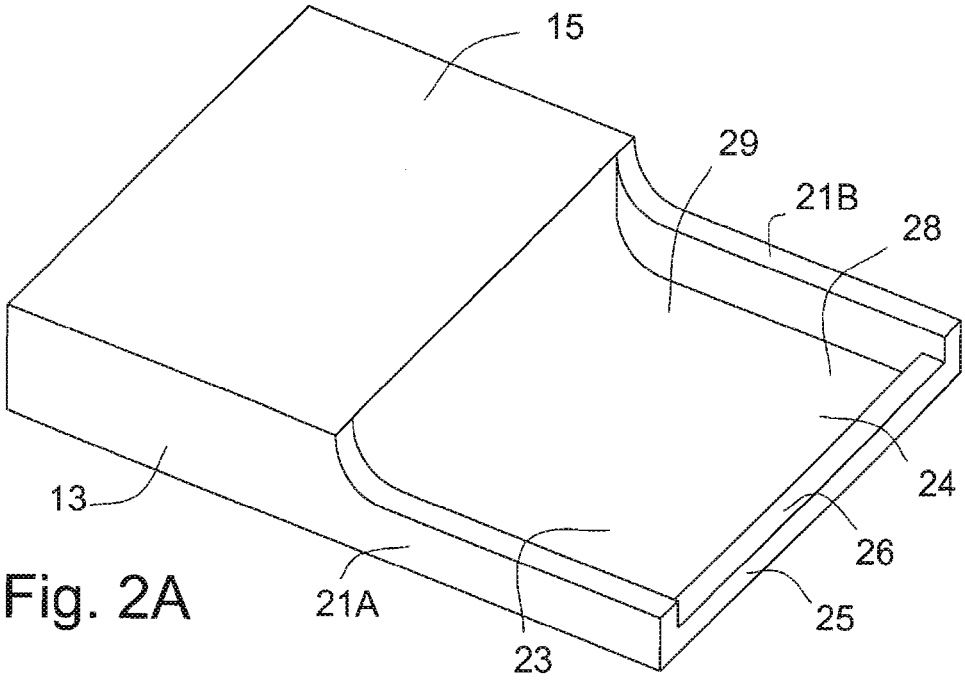
FIG. 2A is a perspective view of a shank and extension of a preferred embodiment of a dressing blade according to this invention.
Figure 2B:
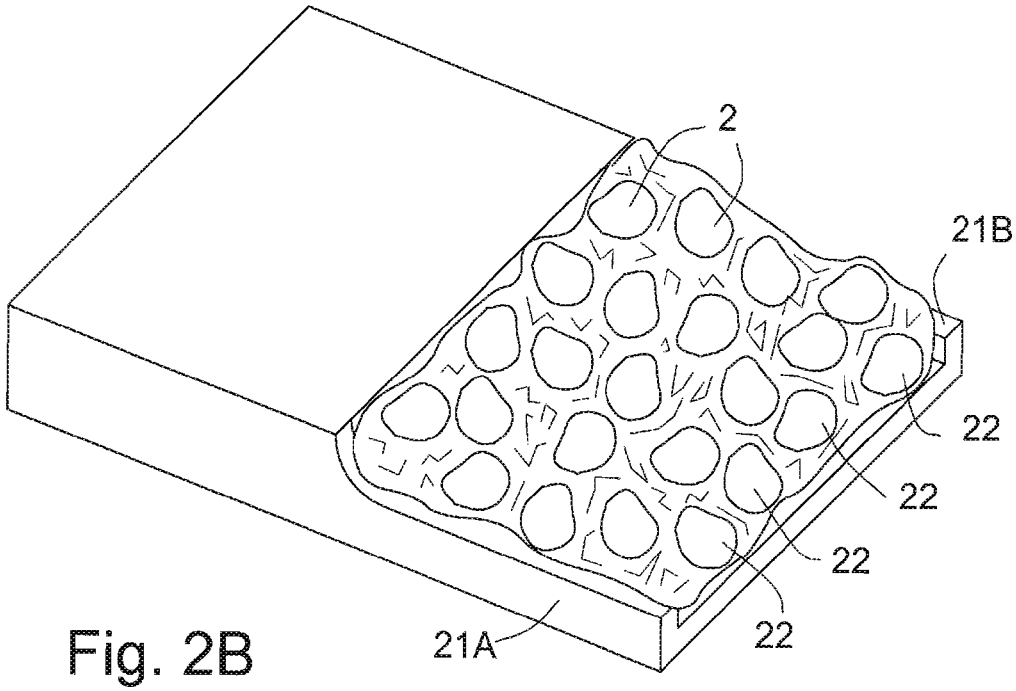
FIG. 2B is a perspective view of a dressing blade formed using the shank and extension of FIG. 2A.

This example describes a tool having a single pocket, illustrating the format described in FIGS. 2A and 2B. The tool was made by first machining a 10 mm square, 1 mm deep milled pocket in a steel bar measuring 2 mm×12.5 mm×38 mm. The pocket was filled with braze paste consisting of 15% by volume of an organic water based binder (Vitta Corp) and 70% by volume of powdered braze components. The braze components consisted of 70% by weight copper, 21% by weight tin and 9% by weight of titanium hydride, $TiH_2$. The pocket was then filled with 20/25 mesh SDA 100+ diamond (DeBeers) by displacing the braze paste. The excess braze paste was removed by wiping, and then the resulting tool was dried in air at room temperature. The tool was then heated for 0.5 hours at 880° C. in a vacuum furnace at a pressure of 0.01-1 μm Hg, followed by cooling to room temperature. It was finished by grinding flat the exposed surface of the abrasive and removing the residual steel at the tool front.

Example 2

The tool prepared in Example 1 was tested in dressing a K grade 80 grit 5SG grinding wheel. Its performance was compared with that of a commercially available dressing tool manufactured by the conventional method of placing diamonds in a powdered metal matrix in a mold and pressing and sintering or hot pressing the assembly to obtain a dense compact. The compaction movement inherent in a powder metal pressing operation often leads to the diamonds moving out of their plane. Two samples of the commercially available blade were utilized. The results of the comparative tests are presented in Table 1. In all cases the traverse rate was 11 in/min. "Wear Ratio" is the ratio of wheel volume removed per unit of tool length.

TABLE 1

| | Wheel Volume Change (cu.in.) | Blade Height Change (in.) | Wear Ratio (cu.in/in.) | Depth of Cut (in.) |
|---|---|---|---|---|
| Ex. 1 | 463 | 0.066 | 7036 | 0.002 |
| Comparative Tool B[1] | | | | |
| Sample 1 | 180 | 0.097 | 1859 | 0.001 |
| Sample 2 | 198 | 0.099 | 2000 | 0.001 |

[1]Cincinnati CM336

These data in Table 1 illustrate that despite doubling the depth of cut for each pass (0.002 in as compared to 0.001 in) the wear ratio of the tool of Example 1 was over three times that of the commercially available dressing blade with identical diamond size. In other trials, the novel blade of Ex. 1 also exhibited about 2 to 5 times better wear ratio than two different, commercial diamond dressing tools of comparable design made with a sintered powdered metal matrix bond.

Example 3

This example describes preparation and testing of a dressing tool having the format illustrated in FIG. 5B.

The tool preform was prepared with a structure of the type seen in FIG. 5A, however, in this example the tool had 9 rows of abrasive brazed into alleys machined into the steel preform (5 alleys exposed on one surface, 4 on the other). The alleys were filled with braze paste consisting of 15% by volume of an organic water based binder (Vitta Corp) and 70% by volume of powdered braze components. The braze powder consisted of 70% by weight copper, 21% by weight tin and 9% by weight of titanium hydride. The alleys were then filled with 20/25 mesh SDA 100+ diamond (DeBeers) by displacing the braze paste. The excess braze paste was removed by wiping, and then the tool was dried in air at room temperature. The tool was then heated for 0.5 hours at 880° C. in a vacuum furnace at a pressure of 0.01-1 μm Hg, followed by cooling to room temperature. The tool was finished by grinding the top and bottom surfaces to open both floors and ceilings of the alleys.

This tool was tested for profiling the regulating wheel of a centerless grinder used in the manufacture of fuel injector pins. It demonstrated twice the life of a commercial, sintered powder metal bonded diamond blade.

Example 4

A tool was made by the same procedure described in Example 1. In this case after the brazing and heating steps, the bar metal that formed the bottom of the pocket of the one-sided blade removed by grinding to expose the bottom side of the diamonds. This resulted in an extremely thin (1.0 mm) very strong blade that was successfully used to traverse profile a glass bonded alumina grinding wheel. Blades of such thin dimension formed by conventional powder metallurgy technology typically lack sufficient strength to endure traverse profiling.

Although specific forms of the invention have been selected in the preceding disclosure for illustration in specific terms for the purpose of describing these forms of the invention fully and amply for one of average skill in the pertinent art, it should be understood that various substitutions and modifications which bring about substantially equivalent or superior results and/or performance are deemed to be within the scope and spirit of the following claims.

What is claimed is:

1. A dressing blade for conditioning abrasive tools comprising:

a slab-shaped metal shank defining a base and a top parallel to the base and having an extension protruding longitudinally from an end of the shank, wherein the extension comprises a plurality of elongated walls parallel to each other and perpendicular to the base of the shank to form one or more elongated alleys between consecutive walls; and an abrasive portion comprising superabrasive grains and a brazed metal composition operative to bond the superabrasive grains to the extension, wherein the superabrasive grains and brazed metal composition are positioned in the one or more alleys, and the superabrasive grains are dispersed within the brazed metal composition in a single layer, and wherein all walls that separate adjacent superabrasive grains and that are comprised by the extension are parallel to one another.

2. The dressing blade of claim 1 wherein the superabrasive grains are selected from the group consisting of diamond grains, cubic boron nitride grains and mixtures thereof.

3. The dressing blade of claim 1 wherein the superabrasive grains are diamond grains.

4. The dressing blade of claim 1 wherein the brazed metal composition comprises a brazing metal component and an active metal component, and the active metal component is selected from the group consisting of titanium, zirconium, chromium, hafnium, and their hydrides, and alloys and combinations thereof.

5. The dressing blade of claim 1 wherein the brazed metal composition comprises a brazing metal component and an active metal component, and the active metal component is titanium or a hydride thereof.

6. The dressing blade of claim 5 wherein the brazing metal component comprises copper and tin.

7. The dressing blade of claim 1 wherein the brazed metal composition comprises a brazing metal component and an active metal component, and the brazing metal component comprises metals selected from the group consisting of copper, silver, tin, zirconium, silicon and iron.

8. The dressing blade of claim 1 wherein the brazed metal composition comprises a brazing metal component and an active metal component, and the brazing metal component comprises copper and tin.

9. The dressing blade of claim 1 wherein the brazed metal composition comprises about 50-90 wt. % copper, about 5-35 wt. % tin and about 5-15 wt. % of titanium or a hydride thereof.

10. The dressing blade of claim 9 wherein the brazed metal composition comprises about 50-80 wt. % copper, about 15-25 wt. % tin and about 5-15 wt. % of titanium or a hydride thereof.

11. The dressing blade of claim 1 wherein the brazed metal composition comprises about 70 wt. % copper, about 21 wt. % tin and about 9 wt. % titanium or a hydride thereof.

12. The dressing blade of claim 1 wherein the superabrasive grains are of size in the range of about 25 mesh to about 4 mesh.

13. The dressing blade of claim 1 wherein all the superabrasive grains are about the same size having a characteristic diameter, and the superabrasive grains and brazed metal composition define an abrasive layer having a thickness of less than two characteristic diameters.

14. The dressing tool of claim 1 wherein the plurality of elongated walls consists of a pair of side panels each of which panels is positioned at opposite lateral sides of the extension.

15. The dressing blade of claim 14 wherein the side panels have a height extending from the base to the top of the shank along their full lengths.

16. The dressing blade of claim 14 wherein the side panels have a height extending from the base to below the top of the shank along a portion of their lengths.

17. The dressing blade of claim 14 wherein the extension further comprises an end panel positioned at an extremity of the extension longitudinally distant from the shank.

18. The dressing blade of claim 1 wherein all the superabrasive grains are about the same size defined by a characteristic diameter and the walls have a height less than two characteristic diameters.

19. The dressing blade of claim 18 wherein there are a plurality of alleys, and the walls are laterally spaced apart by a distance less than two characteristic diameters, and the superabrasive grains within each alley are aligned in a single row extending longitudinally from the shank.

20. The dressing blade of claim 1 wherein the extension further comprises a flat sheet having one side flush with the base and in which the walls extend from the opposite side of the flat sheet.

21. The dressing blade of claim 1 wherein there are a plurality of alleys, and the extension further comprises a plurality of flat sheets extending longitudinally from the shank, the sheets being alternately aligned flush with the top and the base and extending between pairs of walls to form an orthogonal serpentine lateral cross section.

22. The dressing blade of claim 1 wherein the brazed metal composition further comprises a plurality of particles of a hard component other than the superabrasive grains and having a Rockwell C hardness of at least about 1000 Knoop.

23. The dressing blade of claim 22 wherein the hard component is a compound selected from the group consisting of tungsten carbide, titanium boride, silicon carbide, aluminum oxide, chromium boride, chromium carbide and combinations thereof.

24. The dressing blade of claim 1 wherein the brazed metal composition further comprises an infiltrant component operative to eliminate all porosity of the brazed metal composition.

25. The dressing blade of claim 1 wherein there are a plurality of alleys.

26. A method for preparing a dressing blade for conditioning abrasive tools comprising:

providing a slab-shaped metal shank defining a base and a top parallel to the base and having an extension protruding longitudinally from an end of the shank, wherein the extension comprises a plurality of elongated walls parallel to each other and perpendicular to the base of the shank to form one or more elongated alleys between consecutive walls;

applying to the extension a layer of brazing metal composition comprising a brazing metal component and an active metal component;

pressing superabrasive grains into the brazing metal composition to form a single layer of superabrasive grains to obtain a blade precursor, wherein the superabrasive grains and brazed metal composition are positioned in the one or more alleys; and heating the blade precursor to liquefy the brazing metal composition and create a bond between the components of the brazing metal composition and the superabrasive grains, wherein all walls that separate adjacent superabrasive grains and that are comprised by the extension are parallel to one another.

27. The method of claim 26 wherein the plurality of elongated walls consists of a pair of side panels each of which panels is positioned at opposite lateral sides of the extension.

28. The method of claim 27 wherein the extension further comprises an end panel positioned at an extremity of the blade longitudinally distant from the shank.

29. The method of claim 26 wherein the extension further comprises a flat sheet having one side flush with the base and in which the walls extend from the opposite side of the flat sheet.

30. The method of claim 26 wherein there are a plurality of alleys, and the extension further comprises a plurality of flat sheets extending longitudinally from the shank, the sheets being alternately aligned flush with the top and the base and extending between pairs of walls to form an orthogonal serpentine lateral cross section.

31. The method of claim 26 which further comprises robotically or manually individually depositing superabrasive grains on the brazing metal composition.

32. The method of claim 26 in which the blade precursor is heated to a temperature of at least about 880° C.

* * * * *